US009017494B2

(12) United States Patent
Arai et al.

(10) Patent No.: US 9,017,494 B2
(45) Date of Patent: Apr. 28, 2015

(54) METHOD FOR PRODUCING SEAMLESS STEEL PIPE FOR OIL WELLS EXCELLENT IN SULFIDE STRESS CRACKING RESISTANCE

(75) Inventors: Yuji Arai, Amagasaki (JP); Tomohiko Omura, Kishiwada (JP); Keiichi Nakamura, Wakayama (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/212,400

(22) Filed: Aug. 18, 2011

(65) Prior Publication Data

US 2011/0297279 A1 Dec. 8, 2011

Related U.S. Application Data

(60) Division of application No. 11/494,608, filed on Jul. 28, 2006, now abandoned, which is a continuation of application No. PCT/JP2005/001186, filed on Jan. 28, 2005.

(30) Foreign Application Priority Data

Jan. 30, 2004 (JP) ..... 2004-023470

(51) Int. Cl.

| | |
|---|---|
| ***C21D 9/08*** | (2006.01) |
| ***C21D 8/10*** | (2006.01) |
| ***C21D 1/18*** | (2006.01) |
| ***C22C 38/02*** | (2006.01) |
| ***C22C 38/04*** | (2006.01) |
| ***C22C 38/22*** | (2006.01) |

(52) U.S. Cl.

CPC *C21D 8/105* (2013.01); *C21D 1/18* (2013.01); *C21D 8/10* (2013.01); *C21D 9/08* (2013.01); *C21D 9/085* (2013.01); *C22C 38/02* (2013.01); *C22C 38/04* (2013.01); *C22C 38/22* (2013.01); *C21D 2211/008* (2013.01)

(58) Field of Classification Search

CPC ..... C21D 1/18; C21D 8/105; C21D 8/10; C21D 9/08; C21D 9/085; C22C 38/22; C22C 38/02; C22C 38/04

USPC ..... 148/593

See application file for complete search history.

(56) References Cited

U.S. PATENT DOCUMENTS

| | | | | |
|---|---|---|---|---|
| 4,075,041 | A | 2/1978 | Ueno et al. | |
| 5,938,865 | A | 8/1999 | Kondo et al. | |
| 6,024,808 | A * | 2/2000 | Kondo et al. ..... | 148/541 |

FOREIGN PATENT DOCUMENTS

| | | |
|---|---|---|
| AR | 001655 | 11/1997 |
| AR | 005719 | 7/1999 |
| AR | 011312 | 8/2000 |
| CN | 1 161 010 | 10/1997 |
| JP | 04-232209 | 8/1992 |
| JP | 05-271772 | 10/1993 |
| JP | 06-172859 | 6/1994 |
| JP | 06-220536 | 8/1994 |
| JP | 06-322478 | 11/1994 |
| JP | 07-197125 | 8/1995 |
| JP | 2567151 | 3/1996 |
| JP | 09-111343 | 4/1997 |
| JP | 11-335731 | 12/1999 |
| JP | 2000-017389 | 1/2000 |
| JP | 2001-073086 | 3/2001 |
| JP | 3358135 | 11/2002 |

OTHER PUBLICATIONS

Machine translation of JP 2000-017389 (Patent published Jan. 18, 2000).*

J.M. Hodge et al., "Relationship Between Hardenability and Percentage of Martensite in Some Low-Alloy Steels", Transactions of the American Institute of Mining and Metallurgical Engineers, vol. 167, 1946, pp. 627-642.

* cited by examiner

*Primary Examiner* — Jessee Roe
*Assistant Examiner* — Christopher Kessler
(74) *Attorney, Agent, or Firm* — Clark & Brody

(57) ABSTRACT

A high-strength seamless steel pipe for oil wells excellent in sulfide stress cracking resistance which comprises, on the percent by mass basis, C: 0.1 to 0.20%, Si: 0.05 to 1.0%, Mn: 0.05 to 1.0%, Cr: 0.05 to 1.5%, Mo: 0.05 to 1.0%, Al: 0.10% or less, Ti: 0.002 to 0.05% and B: 0.0003 to 0.005%, with a value of equation "C+(Mn/6)+(Cr/5)+(Mo/3)" of 0.43 or more, with the balance being Fe and impurities, and in the impurities P: 0.025% or less, S: 0.010% or less and N: 0.007% or less. The seamless steel pipe may contain a specified amount of one or more element(s) of V and Nb, and/or a specified amount of one or more element(s) of Ca, Mg and REM. The seamless steel pipe can be produced at a low cost by adapting an in-line tube making and heat treatment process having a high production efficiency since a reheating treatment for refinement of grains is not required.

12 Claims, 1 Drawing Sheet

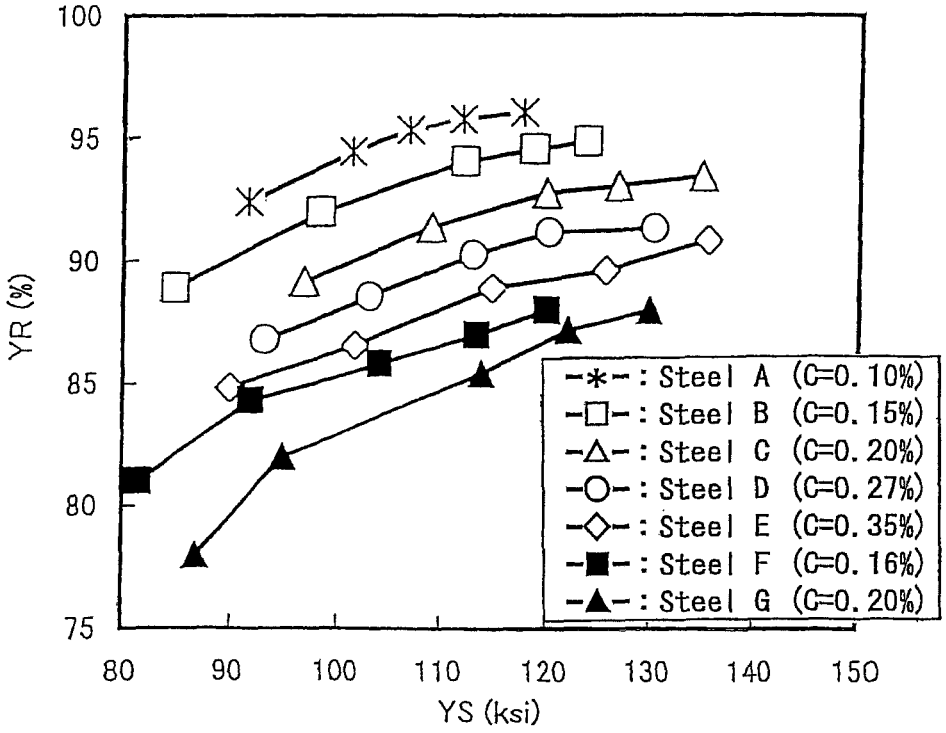
100
95
90
85
80
75
YR (%)
80
90
100
110
120
130
140
150
YS (ksi)
-*- : Steel A (C=0.10%)
-□- : Steel B (C=0.15%)
-△- : Steel C (C=0.20%)
-○- : Steel D (C=0.27%)
-◇- : Steel E (C=0.35%)
-■- : Steel F (C=0.16%)
-▲- : Steel G (C=0.20%)

METHOD FOR PRODUCING SEAMLESS STEEL PIPE FOR OIL WELLS EXCELLENT IN SULFIDE STRESS CRACKING RESISTANCE

This application is a division of U.S. application Ser. No. 11/494,608, filed on Jul. 28, 2006, now abandoned, which is a continuation of the international application PCT/JP2005/001186 filed on Jan. 28, 2005, the entire content of which is herein incorporated by reference.

TECHNICAL FIELD

The present invention relates to a high strength seamless steel pipe which is excellent in sulfide stress cracking resistance and a method for producing the same. More specifically, the present invention relates to a seamless steel pipe for oil wells having a high yield ratio and also excellent sulfide stress cracking resistance, which is produced by the method of quenching and tempering for a specified component-based steel.

"An oil well" in the present specification includes "a gas well", and so, the meaning of "for oil wells" is "for oil and/or gas wells".

BACKGROUND ART

A seamless steel pipe, which is more reliable than a welded pipe, is frequently used in a sever oil well environment or high-temperature environment, and the enhancement of strength, improvement in toughness and improvement in sour resistance are therefore consistently required. Particularly, in oil wells to be developed in future, the enhancement in strength of the steel pipe is needed more than ever before because a high-depth well will become the mainstream, and a seamless steel pipe for oil wells also having stress corrosion cracking resistance is increasingly required because the pipe is used in a severe corrosive environment.

The hardness, namely the dislocation density, of steel product is raised as the strength is enhanced, and the amount of hydrogen to be penetrated into the steel product increases to make the steel product fragile to stress because of the high dislocation density. Accordingly, the sulfide stress cracking resistance is generally deteriorated against the enhancement in strength of the steel product used in a hydrogen sulfide-rich environment. Particularly, when a member having a desired yield strength is produced by use of a steel product with a low ratio of "yield strength/tensile strength" (hereinafter referred to as yield ratio), the tensile strength and hardness are apt to increase, and the sulfide stress cracking resistance is remarkably deteriorated. Therefore, when the strength of the steel product is raised, it is important to increase the yield ratio for keeping the hardness low.

Although it is preferable to make the steel product into a uniform tempered martensitic microstructure for increasing the yield ratio of the steel, that alone is insufficient. As a method for further enhancing the yield ratio in the tempered martensitic microstructure, refinement of prior-austenite grains is given. However, the refinement of austenite grains needs quenching in an off-line heat treatment, which deteriorates the production efficiency and increases the energy used. Therefore, this method is disadvantageous in these days where rationalization of cost, improvement in production efficiency and energy saving are indispensable to manufacturers.

It is described in the Patent Documents 1 and 2 that precipitation of a $M_{23}C_6$ type carbide in grain boundary is inhibited to improve the sulfide stress cracking resistance. An improvement in sulfide stress cracking resistance by refinement of grains is also disclosed in the Patent Document 3. However, such measures have the difficulties as described above.

Patent Document 1: Japanese Laid-Open Patent Publication No. 2001-73086,

Patent Document 2: Japanese Laid-Open Patent Publication No. 2000-17389,

Patent Document 3: Japanese Laid-Open Patent Publication No. 9-111343.

DISCLOSURE OF THE INVENTION

Problems to be Solved by the Invention

From the point of the above-mentioned present situation, the present invention has an object to provide a high strength seamless steel pipe for oil wells having a high yield ratio and an excellent sulfide stress cracking resistance, which can be produced by an efficient means capable of realizing an energy saving.

Mean for Solving the Problems

The gists of the present invention are a seamless steel pipe for oil wells described in the following (1), and a method for producing a seamless steel pipe for oil wells described in the following (2). The percentage for a component content means % based on mass in the following descriptions.

(1) A seamless steel pipe for oil wells which comprises C: 0.1 to 0.20%, Si: 0.05 to 1.0%, Mn: 0.05 to 1.0%, Cr: 0.05 to 1.5%, Mo: 0.05 to 1.0%, Al: 0.1% or less, Ti: 0.002 to 0.05%, B: 0.0003 to 0.005%, further, one or more elements selected from one or both of the following first group and second group as occasion demands, with a value of A determined by the following equation (1) of 0.43 or more, with the balance being Fe and impurities, and in the impurities P: 0.025% or less, S: 0.010% or less and N: 0.007% or less.

First Group:

V: 0.03 to 0.2% and Nb: 0.002 to 0.04%,

Second Group:

Ca: 0.0003 to 0.005%, Mg: 0.0003 to 0.005% and REM: 0.0003 to 0.005%, $$A=C+(Mn/6)+(Cr/5)+(Mo/3) \quad (1),$$

wherein, in the equation (1), C, Mn, Cr and Mo each represent % by mass of the respective elements.

In order to improve the sulfide stress cracking resistance of the steel pipe for oil wells described in (1), preferably the tensile strength is not more than 931 MPa (135 ksi).

(2) A method for producing a seamless steel pipe for oil wells, which comprises the steps of making a pipe by hot-piercing a steel billet having a chemical composition described in the above (1) and a value of A determined by the above equation (1) of 0.43 or more followed by elongating and rolling, and finally rolling at a final rolling temperature adjusted to 800 to 1100 degrees centigrade, assistantly heating the resulting steel pipe in a temperature range from the $Ar_3$ transformation point to 1000 degrees centigrade in-line, and then quenching it from a temperature of the $Ar_3$ transformation point or higher followed by tempering at a temperature lower than the $Ac_1$ transformation point.

In order to obtain more uniform microstructure, in the method for producing a seamless steel pipe for oil well described in (2), preferably the temperature of the assist heating of the steel pipe in-line is between the $Ac_3$ transformation point and 1000 degrees centigrade.

BRIEF DESCRIPTION OF THE DRAWING

FIG. 1 is a graphic representation of the influence of the content of C on the relationship between yield strength (YS) and yield ratio (YR) in a quenched and tempered steel plate.

BEST MODE FOR CARRYING OUT THE INVENTION

The present invention has been accomplished on the basis of the following findings.

The Rockwell C hardness in the position 10 mm from the Jominy end in the Jominy test ($JHRC_{10}$) of each steel A to G and the Rockwell C hardness predicted value at 90%-martensite ratio corresponding to the C content of each steel A to G are shown in Table 1. The position 10 mm from the Jominy end in the Jominy test corresponds to cooling rate of 20 degrees centigrade/second. The predicted value of the Rockwell C hardness at 90%-martensite ratio based on the content C is given by "58C %+27" as shown in the following Non-Patent Document 1.

Non-Patent Document 1: "Relationship between hardenability and percentage martensite in some low alloy steels" by J. M. Hodge and M. A. Orehoski, Trans. AIME, 167, 1946, pp. 627-642.

TABLE 1

| | Chemical composition (mass %) The balance: Fe and impurities | | | | | | | | | | | | | | | | | 58 |
|---|---|---|---|---|---|---|---|---|---|---|---|---|---|---|---|---|---|---|
| Steel | C | Si | Mn | P | S | Cr | Mo | V | Ti | B | Ca | sol. Al | N | A-value | $Ac_1$ point | $Ac_3$ point | $JHRC_{10}$ | C % + 27 |
| A | 0.10 | 0.21 | 0.61 | 0.012 | 0.002 | 0.70 | 0.30 | 0.05 | 0.019 | 0.0010 | 0.0025 | 0.042 | 0.0040 | 0.442 | 758 | 897 | 35.4 | 32.8 |
| B | 0.15 | 0.18 | 0.59 | 0.010 | 0.002 | 0.58 | 0.29 | 0.05 | 0.019 | 0.0010 | 0.0025 | 0.042 | 0.0040 | 0.461 | 754 | 872 | 38.5 | 35.7 |
| C | 0.20 | 0.18 | 0.60 | 0.011 | 0.001 | 0.61 | 0.30 | 0.05 | 0.025 | 0.0012 | 0.0028 | 0.043 | 0.0041 | 0.522 | 753 | 848 | 41.0 | 38.6 |
| D | 0.27 | 0.18 | 0.58 | 0.010 | 0.002 | 0.59 | 0.30 | 0.05 | 0.010 | 0.0015 | 0.0025 | 0.033 | 0.0037 | 0.585 | 752 | 816 | 45.8 | 42.7 |
| E | 0.35 | 0.19 | 0.60 | 0.011 | 0.002 | 0.60 | 0.30 | 0.05 | 0.016 | 0.0013 | 0.0032 | 0.035 | 0.0048 | 0.670 | 750 | 778 | 52.5 | 47.3 |
| F | 0.16 | 0.18 | 0.95 | 0.010 | 0.002 | 0.30 | 0.12 | 0.05 | 0.015 | 0.0010 | 0.0025 | 0.042 | 0.0040 | 0.418 | 739 | 855 | 34.1 | 36.3 |
| G | 0.20 | 0.38 | 0.79 | 0.011 | 0.001 | 0.59 | 0.68 | 0.05 | 0.008 | — | 0.0028 | 0.031 | 0.0041 | 0.676 | 765 | 870 | 36.5 | 38.6 |

A = C + (Mn/6) + (Cr/5) + (Mo/3).

In the columns both "$Ac_1$ point" and "$Ac_3$ point", the temperature unit is "degrees centigrade".

$JHRC_{10}$ means the Rockwell C hardness in the position 10 mm from the quenched end in the Jorniny test.

The yield ratio of a steel product having a quenched and tempered microstructure is most significantly influenced by the content of C. The yield ratio generally increases when the C content is reduced. However, even if the C content is simply reduced, a uniform quenched microstructure cannot be obtained since the hardenability is deteriorated, and the yield ratio cannot be sufficiently raised. Therefore, it is important for the hardenability deteriorated by reducing the C content to be improved by adding Mn, Cr and Mo.

When the A-value of the above-mentioned equation (1) is set to 0.43 or more, a uniform quenched microstructure can be obtained in a general steel pipe quenching facility. The present inventors confirmed that when the A-value of the equation (1) is 0.43 or more, the hardness in a position 10 mm from a quenched end (hereinafter referred to as "Jominy end") in a Jominy test exceeds the hardness corresponding to a martensite ratio of 90% and satisfactory hardenability can be ensured. The A-value is preferably set to 0.45 or more, and more preferably 0.47 or more.

The present inventors further examined the influence of alloy elements on the yield ratio and sulfide stress cracking resistance of a steel product having a quenched and tempered microstructure. The examination results are as follows:

Each of steels having chemical components shown in Table 1 was melted by use of a 150 kg vacuum melting furnace. The obtained steel ingot was hot forged to form a block with 50 mm thickness, 80 mm width and 160 mm length. A Jominy test piece was taken from the remaining ingot austenitized at 1100 degrees centigrade, and submitted to a Jominy test to examine the hardenability of each steel. The prior-austenite grain size of each steel A to G of Table 1 was about No. 5 and relatively coarse.

In the steels A to E with A-values of 0.43 or more of the said equation (1), $JHRC_{10}$ exceeds the Rockwell C hardness corresponding to 90%-martensite ratio, and satisfactory hardenability can be ensured.

On the other hand, the steel F with an A-value smaller than 0.43 of the equation (1) and the steel G containing no B (boron) are short of hardenability since $JHRC_{10}$ is below the Rockwell C hardness corresponding to the 90%-martensite ratio.

Next, above-mentioned each block was subjected to a heating treatment of soaking at 1250 degrees centigrade for 2 hours, immediately carried to a hot rolling machine, and hot-rolled to a thickness of 16 mm at a finish rolling temperature of 950 degrees centigrade or higher. Each hot-rolled material was then carried to a heating furnace before the surface temperature becomes lower than the $Ar_3$ transformation point, allowed to stand therein at 950 degrees centigrade for 10 minutes, and then inserted and water-quenched in an agitating water tank.

Each water-quenched plate was divided to a proper length, and a tempering treatment of soaking for 30 minutes was carried out at various temperatures to obtain quenched and tempered plates. Round bar tensile test pieces were cut off from the longitudinal direction of the thus-obtained hot-rolled and heat-treated plates, and a tensile test was carried out.

FIG. 1 is a graphic representation of the relationship between yield strength (YS) and yield ratio (YR, the unit is represented by %) of plates changed in strength by variously changing the tempering temperature of the steels A to E. The unit of YS is represented by ksi, wherein 1 MPa=0.145 ksi. The concrete data of tempering temperature and tensile properties are shown in Table 2.

TABLE 2

| Steel | Mark | Tempering Temperature | Tensile Properties YS (ksi) | TS (ksi) | YR (%) |
|---|---|---|---|---|---|
| A | 1 | 640 | 118 | 123 | 96.1 |
| | 2 | 660 | 112 | 117 | 95.8 |
| | 3 | 680 | 107 | 112 | 95.4 |
| | 4 | 700 | 102 | 107 | 94.5 |
| | 5 | 720 | 92 | 99 | 92.4 |
| B | 1 | 640 | 124 | 131 | 94.9 |
| | 2 | 660 | 119 | 126 | 94.6 |
| | 3 | 680 | 112 | 119 | 94.1 |
| | 4 | 700 | 98 | 107 | 92.0 |
| | 5 | 720 | 85 | 96 | 88.9 |
| C | 1 | 640 | 135 | 144 | 93.5 |
| | 2 | 660 | 127 | 136 | 93.1 |
| | 3 | 680 | 120 | 129 | 92.8 |
| | 4 | 700 | 109 | 119 | 91.4 |
| | 5 | 720 | 97 | 109 | 89.2 |
| D | 1 | 640 | 131 | 143 | 91.4 |
| | 2 | 660 | 120 | 132 | 91.2 |
| | 3 | 680 | 113 | 125 | 90.3 |
| | 4 | 700 | 103 | 117 | 88.6 |
| | 5 | 720 | 93 | 108 | 86.8 |
| E | 1 | 640 | 136 | 149 | 90.9 |
| | 2 | 660 | 126 | 140 | 89.7 |
| | 3 | 680 | 115 | 129 | 88.9 |
| | 4 | 700 | 102 | 118 | 86.6 |
| | 5 | 720 | 90 | 106 | 84.8 |
| F | 1 | 640 | 120 | 137 | 88.0 |
| | 2 | 660 | 114 | 131 | 87.0 |
| | 3 | 680 | 104 | 125 | 85.8 |
| | 4 | 700 | 92 | 115 | 84.3 |
| | 5 | 720 | 81 | 104 | 81.0 |
| G | 1 | 640 | 130 | 137 | 88.0 |
| | 2 | 660 | 122 | 131 | 87.2 |
| | 3 | 680 | 114 | 125 | 85.4 |
| | 4 | 700 | 95 | 105 | 82.0 |
| | 5 | 720 | 87 | 104 | 78.0 |

In the columns "Tempering Temperature", the temperature unit is "degrees centigrade".

As is apparent from FIG. 1 and Table 2, in spite of the prior-austenite grain sizes are about No. 5, which are relatively coarse, the steels A to C with 0.20% or less of C have yield ratios larger than the steels D to E with 0.25% or more of C by 2% or more. Thus, this clearly shows that a material with high yield ratio can be obtained over a wide strength range by reducing the C content in a quenched and tempered steel while ensuring the hardenability to make the steel into a uniform quenched microstructure. It is apparent that the effect of raising the yield ratio cannot be obtained in the steels F to G even with 0.20% or less of C but insufficient hardenability.

The reason for specifying the chemical composition of the steel of a seamless steel pipe for oil wells in the present invention will be now described in detail.

C:

C is an element effective for inexpensively enhancing the strength of steel. However, with the C content of less than 0.1%, a low-temperature tempering must be performed to obtain a desired strength, which causes a deterioration in sulfide stress cracking resistance, or the necessity of addition of a large amount of expensive elements to ensure the hardenability. With the C content exceeding 0.20%, the yield ratio is reduced, and when a desired yield strength is obtained, a rise of hardness is caused to deteriorate the sulfide stress cracking resistance. Accordingly, the C content is set to 0.1 to 0.20%. The preferable range of the C content is 0.12 to 0.18%, and the more preferable range is 0.14 to 0.18%.

Si:

Si is an element, which enhances the hardenability of steel to improve the strength in addition to deoxidation effect, and a content of 0.05% or more is required. However, when the Si content exceeds 1.0%, the sulfide stress cracking resistance is deteriorated. Accordingly, the proper content of Si is 0.05 to 1.0%. The preferable range of the Si content is 0.1 to 0.6%.

Mn:

Mn is an element, which enhances the hardenability of steel to improve the strength in addition to deoxidation effect, and a content of 0.05% or more is required. However, when the Mn content exceeds 1.0%, the sulfide stress cracking resistance is deteriorated. Accordingly, the content of Mn is set to 0.05 to 1.0%

P:

P is an impurity of steel, which causes a deterioration in toughness resulted from grain boundary segregation. Particularly when the P content exceeds 0.025%, the sulfide stress cracking resistance is remarkably deteriorated. Accordingly, it is necessary to control the content of P to 0.025% or less. The P content is preferably set to 0.020% or less and, more preferably, to 0.015% or less.

S:

S is also an impurity of steel, and when the S content exceeds 0.010%, the sulfide stress cracking resistance is seriously deteriorated. Accordingly, the content of S is set to 0.010% or less. The S content is preferably 0.005% or less.

Cr:

Cr is an element effective for enhancing the hardenability of steel, and a content of 0.05% or more is required in order to exhibit this effect. However, when the Cr content exceeds 1.5%, the sulfide stress cracking resistance is deteriorated. Therefore, the content of Cr is set to 0.05 to 1.5%. The preferable range of the Cr content is 0.2 to 1.0%, and the more preferable range is 0.4 to 0.8%.

Mo:

Mo is an element effective for enhancing the hardenability of steel to ensure a high strength and for enhancing the sulfide stress cracking resistance. In order to obtain these effects, it is necessary to control the content of Mo to 0.05% or more. However, when the Mo content exceeds 1.0%, coarse carbides are formed in the prior-austenite grain boundaries to deteriorate the sulfide stress cracking resistance. Therefore, the content of Mo is set to 0.05 to 1.0%. The preferable range of the Mo content is 0.1 to 0.8%.

Al:

Al is an element having a deoxidation effect and effective for enhancing the toughness and workability of steel. However, when the content of Al exceeds 0.10%, streak flaws are remarkably caused. Accordingly, the content of Al is set to 0.10% or less. Although the lower limit of the Al content is not particularly set because the content may be in an impurity level, the Al content is preferably set to 0.005% or more. The preferable range of the Al content is 0.005 to 0.05%. The Al content referred herein means the content of acid-soluble Al (what we called the "sol.Al").

B:

Although the hardenability improving effect of B can be obtained with a content of impurity level, the B content is preferably set to 0.0003% or more in order to obtain the effect more remarkably. However, when the content of B exceeds 0.005%, the toughness is deteriorated. Therefore, the content of B is set to 0.0003 to 0.005%. The preferable range of the B content is 0.0003 to 0.003%.

Ti:

Ti fixes N in steel as a nitride and makes B present in a dissolved state in the matrix at the time of quenching to make it exhibit the hardenability improving effect. In order to obtain such an effect of Ti, the content of Ti is preferably set to 0.002% or more. However, when the content of Ti is 0.05% or more, it is present as a coarse nitride, resulting in the deterioration of the sulfide stress cracking resistance. Accordingly, the content of Ti is set to 0.002 to 0.05%. The preferable range of Ti content is 0.005 to 0.025%.

N:

N is unavoidably present in steel, and binds to Al, Ti or Nb to form a nitride. The presence of a large amount of N not only leads to the coarsening of AlN or TiN but also remarkably deteriorates the hardenability by also forming a nitride with B. Accordingly, the content of N as an impurity element is set to 0.007% or less. The preferable range of N is less than 0.005%.

Limitation of the A-value calculated by the equation (1):

The A-value is defined by the following equation (1) as described above, wherein C, Mn, Cr, and Mo in the equation (1) mean the percentage of the mass of the respective elements.

$$A=C+(Mn/6)+(Cr/5)+(Mo/3) \quad (1).$$

The present invention is intended to raise the yield ratio by limiting C to improve the sulfide stress cracking resistance. Accordingly, if the contents of Mn, Cr, and Mo are not adjusted according to the adjustment of the C content, the hardenability is impaired to rather deteriorate the sulfide stress cracking resistance. Therefore, in order to ensure the hardenability, the contents of C, Mn, Cr and Mo must be set so that the said A-value of the equation (1) is 0.43 or more. The said A-value is preferably set to 0.45 or more, and more preferably to 0.47 or more.

The optional components of the first group and the second group which are included as occasion demands will be then described.

The first group consists of V and Nb. V precipitates as a fine carbide at the time of tempering, and so it has an effect to enhance the strength. Although such effect is exhibited by including 0.03% or more of V, the toughness is deteriorated with the content exceeding 0.2%. Accordingly, the content of added V is preferably set to 0.03 to 0.2%. The more preferable range of the V content is 0.05 to 0.15%.

Nb forms a carbonitride in a high temperature range to prevent the coarsening of grains to effectively improve the sulfide stress cracking resistance. When the content of Nb is 0.002% or more, this effect can be exhibited. However, when the content of Nb exceeds 0.04%, the carbonitride is excessively coarsened to rather deteriorate the sulfide stress cracking resistance. Accordingly, the content of added Nb is preferably set to 0.002 to 0.04%. The more preferable range of the Nb content is 0002 to 0.02%.

The second group consists of Ca, Mg and REM. These elements are not necessarily added. However, since they react with S in steel when added, to form sulfides to thereby improve the form of an inclusion, the sulfide stress cracking resistance of the steel can be improved as an effect. This effect can be obtained, when one or two or more selected from the group of Ca, Mg and REM (rare earth elements, namely Ce, Ra, Y and so on) is added. When the content of each element is less than 0.0003%, the effect cannot be obtained. When the content of every element exceeds 0.005%, the amount of inclusions in steel is increased, and the cleanliness of the steel is deteriorated to reduce the sulfide stress cracking resistance. Accordingly, the content of added each element is preferably set to 0.0003 to 0.005%. In the present invention, the content of REM means the sum of the contents of rare earth elements.

Previously described, in general, the higher the strength of a steel becomes, the worse the sulfide stress cracking resistance becomes in the circumstance containing much hydrogen sulfide. But the seamless steel pipe for oil wells comprising the chemical compositions described above retains the good sulfide stress cracking resistance if the tensile strength is not more than 931 MPa. Therefore the tensile strength of the seamless steel pipe for oil well is preferably not more than 931 MPa (135 ksi). More preferably the upper limit of the tensile strength is 897 MPa (130 ksi).

Next, the method for producing a seamless steel pipe for oil wells of the present invention will be described.

The seamless steel pipe for oil wells of the present invention is excellent in sulfide stress cracking resistance with a high yield ratio even if it has a relatively coarse microstructure such that the microstructure is mainly composed of tempered martensite with an prior-austenite grain of No. 7 or less by a grain size number regulated in JIS G 0551 (1998). Accordingly, when a steel ingot having the above-mentioned chemical composition is used as a material, the freedom of selection for the method for producing a steel pipe can be increased.

For example, the said seamless steel pipe can be produced by supplying a steel pipe formed by piercing and elongating by the Mannesmann-mandrel mill tube-making method to a heat treatment facility provided in the latter stage of a finish rolling machine while keeping it at a temperature of the $Ar_3$ transformation point or higher to quench it followed by tempering at 600 to 750 degrees centigrade. Even if an energy-saving type in-line tube making and heat treatment process such as the above-mentioned process is selected, a steel pipe with high yield ratio can be produced, and a seamless steel pipe for oil wells having a desired high strength and high sulfide stress cracking resistance can be obtained.

The said seamless steel pipe can be also produced by cooling a hot-finish formed steel pipe once down to room temperature, reheating it in a quenching furnace to soak in a temperature range of 900 to 1000 degrees centigrade followed by quenching in water, and then tempering at 600 to 750 degrees centigrade. If an off-line tube making and heat treatment process such as the above-mentioned process is selected, a steel pipe having a higher yield ratio can be produced by the refinement effect of prior-austenite grain, and a seamless steel pipe for oil wells with higher strength and higher sulfide stress cracking resistance can be obtained.

However, the production method described below is most desirable. The reason is that since the pipe is held at a high temperature from the tube-making to the quenching, an element such as V or Mo can be easily kept in a dissolved state in the matrix, and such elements precipitates in a high-temperature tempering which is advantageous for improving the sulfide stress cracking resistance, and contribute to the increase in strength of the steel pipe.

The method for producing a seamless steel pipe for oil wells of the present invention is characterized in the final rolling temperature of elongating and rolling, and the heat treatment after the end of rolling. Each will be described below.

(1) Final Rolling Temperature of Elongating and Rolling

This temperature is set to 800 to 1100 degrees centigrade. At a temperature lower than 800 degrees centigrade, the deformation resistance of the steel pipe is excessively increased to cause a problem of tool abrasion. At a temperature higher than 1100 degrees centigrade, the grains are excessively coarsened to deteriorate the sulfide stress cracking resistance. The piercing process before the elongating and rolling may be carried out by a general method, such as Mannesmann piercing method.

(2) Assistant Heating Treatment

The elongated and rolled steel pipe is charged in line, namely in a assistant heating furnace provided within a series of steel pipe production lines, and assistantly heated in a temperature range from the $Ar_3$ transformation point to 1000 degrees centigrade. The purpose of the assistant heating is to eliminate the dispersion in the longitudinal temperature of the steel pipe to make the microstructure uniform.

When the temperature of the assistant heating is lower than the $Ar_3$ transformation point, a ferrite starts to generate, and the uniform quenched microstructure cannot be obtained. When it is higher than 1000 degrees centigrade, the grain growth is promoted to cause the deterioration of the sulfide stress cracking resistance by grain coarsening. The time of the assistant heating is set to a time necessary for making the temperature of the whole thickness of the pipe to a uniform temperature, that is about 5 to 10 minutes. Although the assistant heating process may be omitted when the final rolling temperature of elongating and rolling is within a temperature range from the $Ar_3$ transformation point to 1000 degrees centigrade, the assistant heating is desirably carried out in order to minimize the longitudinal and thickness-directional dispersion in temperature of the pipe.

The more uniform microstructure is obtained when the temperature of the assist heating of a steel pipe in-line is between the $Ac_3$ transformation point and 1000 degrees centigrade. Therefore, the temperature of the assist heating of a steel pipe in-line is preferably between the $Ac_3$ transformation point and 1000 degrees centigrade.

(3) Quenching and Tempering

The steel pipe laid in a temperature range from the $Ar_3$ transformation point to 1000 degrees centigrade through the above processes is quenched. The quenching is carried out at a cooling rate sufficient for making the whole thickness of the pipe into a martensitic microstructure. Water cooling can be generally adapted. The tempering is carried out at a temperature lower than the $Ac_1$ transformation point, desirably, at 600 to 700 degrees centigrade. The tempering time may be about 20 to 60 minutes although it depends on the thickness of the pipe.

According to the above processes, a seamless steel pipe for oil wells with excellent properties formed of tempered martensite can be obtained.

PREFERRED EMBODIMENT

The present invention will be described in more detail in reference to preferred embodiments.

Example 1

Billets with an outer diameter of 225 mm formed of 28 kinds of steels shown in Table 3 were produced. These billets were heated to 1250 degrees centigrade, and formed into seamless steel pipes with 244.5 mm outer diameter and 13.8 mm thickness by the Mannesmann-mandrel tube-making method.

TABLE 3

| | Chemical composition (mass %) The balance: Fe and impurities | | | | | | | | | | |
|---|---|---|---|---|---|---|---|---|---|---|---|
| Steel | C | Si | Mn | P | S | Cr | Mo | B | sol. Al | N | Ti |
| 1 | 0.12 | 0.26 | 0.91 | 0.010 | 0.002 | 0.43 | 0.35 | 0.0012 | 0.024 | 0.0039 | 0.018 |
| 2 | 0.11 | 0.33 | 0.61 | 0.010 | 0.004 | 0.61 | 0.51 | 0.0021 | 0.026 | 0.0038 | 0.007 |
| 3 | 0.15 | 0.22 | 0.61 | 0.010 | 0.004 | 0.30 | 0.50 | 0.0012 | 0.025 | 0.0041 | 0.013 |
| 4 | 0.20 | 0.25 | 0.60 | 0.010 | 0.004 | 0.31 | 0.50 | 0.0013 | 0.029 | 0.0040 | 0.020 |
| 5 | 0.17 | 0.30 | 0.60 | 0.010 | 0.004 | 0.61 | 0.45 | 0.0012 | 0.032 | 0.0036 | 0.011 |
| 6 | 0.13 | 0.23 | 0.63 | 0.010 | 0.004 | 0.60 | 0.61 | 0.0003 | 0.031 | 0.0018 | 0.007 |
| 7 | 0.13 | 0.40 | 0.75 | 0.011 | 0.004 | 0.36 | 0.58 | 0.0012 | 0.028 | 0.0037 | 0.013 |
| 8 | 0.16 | 0.30 | 0.80 | 0.011 | 0.004 | 0.30 | 0.51 | 0.0011 | 0.028 | 0.0043 | 0.013 |
| 9 | 0.15 | 0.19 | 0.82 | 0.010 | 0.004 | 0.25 | 0.40 | 0.0010 | 0.030 | 0.0047 | 0.014 |
| 10 | 0.15 | 0.63 | 0.40 | 0.010 | 0.004 | 0.60 | 0.30 | 0.0015 | 0.029 | 0.0041 | 0.016 |
| 11 | 0.16 | 0.19 | 0.62 | 0.010 | 0.004 | 0.89 | 0.16 | 0.0019 | 0.031 | 0.0043 | 0.008 |
| 12 | 0.14 | 0.22 | 0.44 | 0.008 | 0.004 | 0.88 | 0.36 | 0.0010 | 0.030 | 0.0035 | 0.008 |
| 13 | 0.14 | 0.19 | 0.60 | 0.008 | 0.004 | 0.61 | 0.48 | 0.0013 | 0.028 | 0.0044 | 0.013 |
| 14 | 0.16 | 0.22 | 0.63 | 0.009 | 0.004 | 0.30 | 0.51 | 0.0011 | 0.026 | 0.0024 | 0.006 |
| 15 | 0.15 | 0.17 | 0.79 | 0.008 | 0.004 | 0.30 | 0.50 | 0.0013 | 0.024 | 0.0027 | 0.013 |
| 16 | 0.15 | 0.17 | 0.99 | 0.009 | 0.004 | 0.61 | 0.31 | 0.0026 | 0.026 | 0.0024 | 0.003 |
| 17 | 0.15 | 0.18 | 0.87 | 0.009 | 0.004 | 0.21 | 0.72 | 0.0022 | 0.028 | 0.0040 | 0.007 |
| 18 | 0.18 | 0.17 | 0.50 | 0.008 | 0.004 | 0.51 | 0.72 | 0.0012 | 0.029 | 0.0035 | 0.011 |
| 19 | 0.16 | 0.18 | 0.81 | 0.009 | 0.004 | 0.51 | 0.73 | 0.0012 | 0.030 | 0.0038 | 0.014 |
| 20 | 0.13 | 0.20 | 0.57 | 0.006 | 0.003 | 0.57 | 0.32 | 0.0017 | 0.036 | 0.0049 | 0.012 |
| 21 | 0.14 | 0.46 | 0.81 | 0.015 | 0.003 | 0.36 | 0.26 | 0.0008 | 0.031 | 0.0018 | 0.018 |
| 22 | 0.17 | 0.33 | 0.68 | 0.011 | 0.003 | 0.87 | 0.16 | 0.0019 | 0.033 | 0.0022 | 0.002 |
| 23 | 0.16 | 0.31 | 0.48 | 0.008 | 0.002 | 0.36 | 0.45 | 0.0011 | 0.034 | 0.0038 | 0.011 |
| 24 | 0.16 | 0.41 | 0.48 | 0.012 | 0.003 | 0.10 | *0.01 | 0.0010 | 0.019 | 0.0010 | 0.012 |
| 25 | 0.14 | 0.22 | 0.81 | 0.012 | 0.002 | 0.16 | 0.08 | 0.0011 | 0.031 | 0.0052 | 0.014 |
| 26 | 0.12 | 0.33 | 0.61 | 0.008 | 0.003 | *1.63 | 0.77 | 0.0015 | 0.025 | 0.0038 | 0.012 |
| 27 | 0.17 | 0.28 | 0.56 | 0.011 | 0.003 | 0.92 | *0.01 | 0.0012 | 0.031 | 0.0041 | 0.015 |
| 28 | *0.26 | 0.27 | 0.51 | 0.012 | 0.004 | 0.60 | 0.30 | 0.0010 | 0.031 | 0.0045 | 0.013 |

| | Chemical composition (mass %) The balance: Fe and impurities | | | | | | $Ac_1$ | $Ac_3$ |
|---|---|---|---|---|---|---|---|---|
| Steel | Nb | V | Ca | Mg | REM | A-value | point | point |
| 1 | — | — | — | — | — | 0.474 | 755 | 888 |
| 2 | — | — | — | — | — | 0.504 | 767 | 907 |
| 3 | — | — | — | — | — | 0.478 | 757 | 883 |
| 4 | — | — | — | — | — | 0.529 | 756 | 861 |
| 5 | — | — | — | — | — | 0.542 | 763 | 875 |
| 6 | — | — | — | — | — | 0.558 | 767 | 896 |
| 7 | — | — | — | — | — | 0.520 | 762 | 903 |

TABLE 3-continued

| | | | | | | | | |
|---|---|---|---|---|---|---|---|---|
| 8 | — | — | — | — | — | 0.523 | 756 | 880 |
| 9 | — | — | — | — | — | 0.470 | 750 | 874 |
| 10 | — | — | 0.0012 | — | — | 0.437 | 768 | 901 |
| 11 | — | — | 0.0031 | — | — | 0.495 | 761 | 861 |
| 12 | — | — | — | 0.0010 | — | 0.509 | 769 | 883 |
| 13 | 0.006 | — | — | — | — | 0.522 | 765 | 884 |
| 14 | — | 0.18 | — | — | — | 0.495 | 749 | 879 |
| 15 | 0.005 | — | — | — | — | 0.508 | 755 | 877 |
| 16 | 0.008 | 0.05 | — | — | — | 0.540 | 753 | 864 |
| 17 | 0.011 | 0.08 | — | — | — | 0.577 | 754 | 885 |
| 18 | — | — | 0.0021 | — | — | 0.605 | 766 | 876 |
| 19 | — | 0.15 | 0.0019 | — | — | 0.640 | 757 | 880 |
| 20 | 0.002 | 0.13 | 0.0020 | — | — | 0.446 | 753 | 884 |
| 21 | — | — | 0.0010 | 0.0005 | — | 0.434 | 754 | 888 |
| 22 | — | — | 0.0008 | 0.0001 | 0.001 | 0.511 | 762 | 863 |
| 23 | 0.003 | 0.08 | 0.0010 | 0.0010 | — | 0.462 | 756 | 884 |
| 24 | — | — | — | — | — | *0.263 | 747 | 874 |
| 25 | — | — | — | — | — | *0.334 | 741 | 869 |
| 26 | — | — | 0.0018 | — | — | 0.804 | 798 | 908 |
| 27 | — | — | — | — | — | 0.451 | 761 | 857 |
| 28 | 0.003 | 0.06 | — | — | — | 0.565 | 756 | 827 |

A = C + (Mn/6) + (Cr/5) + (Mo/3).
In the columns both "$Ac_1$ point" and "$Ac_3$ point", the temperature unit is "degrees centigrade".
The symbol "*" means that the content fails to satisfy the conditions specified in the invention.

Each formed seamless steel pipe was charged in a assistant heating furnace of a furnace temperature of 950 degrees centigrade constituting a heat treatment facility provided in the latter stage of a finish rolling machine (namely elongating and rolling machine), allowed to stand therein to uniformly and assistantly heated for 5 minutes, and then quenched in water.

The water-quenched seamless steel pipe was charged in a tempering furnace, and subjected to a tempering treatment of uniformly soaking at a temperature between 650 and 720 degrees centigrade for 30 minutes, and the strength was adjusted to about 110 ksi (758 MPa) in terms of yield strength to produce a product steel pipe, namely a seamless steel pipe for oil wells. The grain size of the said water-quenched steel pipe was No. 7 or less by the grain size number regulated in JIS G 0551 (1998) in all the steels Nos. 1 to 28.

Various test pieces were taken from the product steel pipe, and the following tests were carried out to examine the properties of the steel pipe. The hardenability of each steel was also examined.

1. Hardenability

A Jominy test piece was taken from each billet before tube-making rolling, austenitized at 1100 degrees centigrade, and subjected to a Jominy test. The hardenability was evaluated by comparing the Rockwell C hardness in a position 10 mm from a Jominy end ($JHRC_{10}$) with the value of 58C %+27, which is a predicted value of the Rockwell C hardness corresponding to 90%-martensite ratio of each steel, and determining one having a $JHRC_{10}$ higher than the value of 58C %+27 to have "excellent hardenability", and one having a $JHRC_{10}$ not higher than the value of 58C %+27 to have "inferior hardenability".

2. Tensile Test

A circular tensile test piece regulated in 5CT of the API standard was cut off from the longitudinal direction of each steel pipe, and a tensile test was carried out to measure the yield strength YS (ksi), tensile strength TS (ksi) and yield ratio YR (%).

3. Corrosion Test

An A-method test piece regulated in NACE TM0177-96 was cut off from the longitudinal direction of each steel pipe, and an NACE A-method test was carried out in the circumstance of 0.5% acetic acid and 5% sodium chloride aqueous solution saturated with hydrogen sulfide of the partial pressure of 101325 Pa (1 atm) to measure a limit applied stress (that is maximum stress causing no rupture in a test time of 720 hours, shown by the ratio to the actual yield strength of each steel pipe). The sulfide stress cracking resistance was determined to be excellent when the limit applied stress was 90% or more of YS.

The examination results are shown in Table 4. The column of hardenability of Table 4 is shown by "excellent" or "inferior" by comparison between $JHRC_{10}$ and the value of 58C %+27.

TABLE 4

| | | Tensile Properties | | | Limit |
|---|---|---|---|---|---|
| Steel | Hardenability | YS (ksi) | TS (ksi) | YR (%) | Applied Stress |
| 1 | Excellent | 108 | 113 | 95.6 | 90% YS |
| 2 | Excellent | 107 | 112 | 95.5 | 90% YS |
| 3 | Excellent | 110 | 117 | 94.0 | 90% YS |
| 4 | Excellent | 109 | 119 | 91.6 | 90% YS |
| 5 | Excellent | 109 | 117 | 93.2 | 90% YS |
| 6 | Excellent | 106 | 111 | 95.5 | 90% YS |
| 7 | Excellent | 108 | 113 | 95.6 | 90% YS |
| 8 | Excellent | 105 | 113 | 92.9 | 90% YS |
| 9 | Excellent | 108 | 115 | 93.9 | 90% YS |
| 10 | Excellent | 105 | 113 | 92.9 | 95% YS |
| 11 | Excellent | 110 | 117 | 94.0 | 95% YS |
| 12 | Excellent | 107 | 112 | 95.5 | 95% YS |
| 13 | Excellent | 105 | 112 | 93.8 | 90% YS |
| 14 | Excellent | 110 | 117 | 94.0 | 95% YS |
| 15 | Excellent | 110 | 118 | 93.2 | 90% YS |
| 16 | Excellent | 109 | 117 | 93.2 | 90% YS |
| 17 | Excellent | 108 | 116 | 93.1 | 90% YS |
| 18 | Excellent | 108 | 114 | 94.7 | 90% YS |
| 19 | Excellent | 110 | 118 | 93.2 | 90% YS |
| 20 | Excellent | 109 | 117 | 93.2 | 90% YS |
| 21 | Excellent | 106 | 111 | 95.5 | 90% YS |
| 22 | Excellent | 108 | 114 | 94.7 | 90% YS |
| 23 | Excellent | 110 | 116 | 94.8 | 95% YS |
| 24 | Inferior | 110 | 124 | 88.7 | 80% YS |
| 25 | Inferior | 100 | 121 | 82.6 | 70% YS |
| 26 | Excellent | 110 | 116 | 94.8 | 75% YS |
| 27 | Excellent | 108 | 117 | 92.3 | 75% YS |
| 28 | Excellent | 110 | 125 | 88.0 | 80% YS |

As is apparent from Table 4, the steels Nos. 1 to 12, 14, 18, 19, 21 and 22, having chemical compositions regulated in the present invention, have excellent hardenability, high yield ratio, and excellent sulfide stress cracking resistance.

On the other hand, all the steels Nos. 24 to 38, out of the component range regulated in the present invention, are inferior in sulfide stress crack resistance.

The steel No. 24 is too short of hardenability to obtain the uniform quenched and tempered microstructure, namely the uniform tempered martensitic microstructure, and also poor in sulfide stress cracking resistance with a low yield ratio, since the content of Mo is out of the range regulated in the present invention.

The steel No. 25 is too short of hardenability to obtain the uniform quenched and tempered microstructure, namely the uniform tempered martensitic microstructure, and also poor in sulfide stress cracking resistance with a low yield ratio, since the conditions regulated in the present invention are not satisfied with an A-value of the said equation (1) lower than 0.43 although the independent contents of C, Mn, Cr and Mo are within the ranges regulated in the present invention.

The steel No. 26 is excellent in hardenability and has a high yield ratio, but it is poor in sulfide stress cracking resistance since the content of Cr is higher than the regulation in the present invention.

The steel No. 27 is short of hardenability, and also poor in sulfide stress cracking resistance with a low yield ratio, since the content of Mo is lower than the lower limit value regulated in the present invention although the A-value of the said equation (1) satisfies the condition regulated in the present invention.

The steel No. 28 is excellent in hardenability, but it is inferior in sulfide stress cracking resistance with a low yield ratio, since the content of C is higher than the regulation of the present invention.

Example 2

Billets with an outer diameter of 225 mm formed of 3 kinds of steels shown in Table 5 were produced. These billets were heated to 1250 degrees centigrade, and formed into seamless steel pipes with 244.5 mm outer diameter and 13.8 mm thickness by the Mannesmann-mandrel tube-making method. The steels Nos. 29 to 31 in Table 5 satisfied the chemical composition defined by the present invention.

TABLE 5

| | Chemical composition (mass %) The balance: Fe and impurities | | | | | | | | | | |
|---|---|---|---|---|---|---|---|---|---|---|---|
| Steel | C | Si | Mn | P | S | Cr | Mo | B | sol. Al | N | Ti |
| 29 | 0.15 | 0.15 | 0.76 | 0.010 | 0.002 | 0.35 | 0.40 | 0.0013 | 0.025 | 0.0032 | 0.016 |
| 30 | 0.19 | 0.21 | 0.61 | 0.010 | 0.002 | 0.45 | 0.30 | 0.0009 | 0.021 | 0.0038 | 0.013 |
| 31 | 0.14 | 0.32 | 0.66 | 0.008 | 0.001 | 0.41 | 0.71 | 0.0012 | 0.025 | 0.0041 | 0.013 |

| | Chemical composition (mass %) The balance: Fe and impurities | | | | | | $Ac_1$ | $Ac_3$ |
|---|---|---|---|---|---|---|---|---|
| Steel | Nb | V | Ca | Mg | REM | A-value | point | point |
| 29 | — | 0.07 | 0.0018 | — | — | 0.480 | 750 | 872 |
| 30 | — | 0.10 | — | 0.0008 | — | 0.482 | 752 | 855 |
| 31 | — | 0.12 | 0.0020 | — | 0.0005 | 0.569 | 761 | 900 |

A = C + (Mn/6) + (Cr/5) + (Mo/3).

In the columns both "$Ac_1$ point" and "$Ac_3$ point", the temperature unit is "degrees centigrade".

Each formed seamless steel pipe was charged in a assistant heating furnace of a furnace temperature of 950 degrees centigrade constituting a heat treatment facility provided in the latter stage of a finish rolling machine (namely elongating and rolling machine), allowed to stand therein to uniformly and assistantly heated for 5 minutes, and then quenched in water.

The water-quenched seamless steel pipe was divided in two pieces and charged in a tempering furnace, and subjected to a tempering treatment of uniformly soaking for each piece at a temperature between 650 and 720 degrees centigrade for 30 minutes, and the strength was adjusted to about 125 ksi (862 MPa) to 135 ksi (931 MPa) in terms of tensile strength to produce a product steel pipe, namely a seamless steel pipe for oil wells. The grain size of the said water-quenched steel pipe was No. 7 or less by the grain size number regulated in JIS G 0551 (1998) in all the steels Nos. 29 to 31.

Various test pieces were taken from the product steel pipe, and the following tests were carried out to examine the properties of the steel pipe. The hardenability of each steel was also examined.

1. Hardenability

A Jominy test piece was taken from each billet before tube-making rolling, austenitized at 1100 degrees centigrade, and subjected to a Jominy test. The hardenability was evaluated by comparing the Rockwell C hardness in a position 10 mm from a Jominy end ($JHRC_{10}$ with the value of 58C %+27, which is a predicted value of the Rockwell C hardness corresponding to 90%-martensite ratio of each steel, and determining one having a $JHRC_{10}$ higher than the value of 58C %+27 to have "excellent hardenability", and one having a $JHRC_{10}$ not higher than the value of 58C %+27 to have "inferior hardenability".

2. Tensile Test

A circular tensile test piece regulated in 5CT of the API standard was cut off from the longitudinal direction of each steel pipe, and a tensile test was carried out to measure the yield strength YS (ksi), tensile strength TS (ksi) and yield ratio YR (%).

3. Corrosion Test

An A-method test piece regulated in NACE TM0177-96 was cut off from the longitudinal direction of each steel pipe, and an NACE A-method test was carried out in the circumstance of 0.5% acetic acid and 5% sodium chloride aqueous solution saturated with hydrogen sulfide of the partial pressure of 101325 Pa (1 atm) to measure a limit applied stress (that is maximum stress causing no rupture in a test time of 720 hours, shown by the ratio to the actual yield strength of each steel pipe). The sulfide stress cracking resistance was determined to be excellent when the limit applied stress was 90% or more of YS.

The examination results are shown in Table 6. The column of hardenability of Table 6 is shown by "excellent" or "inferior" by comparison between $JHRC_{10}$ and the value of 58C %+27.

TABLE 6

| | | | Tensile Properties | | | Limit |
|---|---|---|---|---|---|---|
| Mark | Steel | Hardenability | YS (ksi) | TS (ksi) | YR (%) | Applied Stress |
| 29-1 | 29 | Excellent | 125 | 132 | 94.7 | 90% YS |
| 29-2 | 29 | Excellent | 120 | 127 | 94.5 | 95% YS |
| 30-1 | 30 | Excellent | 125 | 135 | 92.6 | 90% YS |
| 30-2 | 30 | Excellent | 121 | 130 | 93.1 | 95% YS |
| 31-1 | 31 | Excellent | 125 | 130 | 96.2 | 95% YS |
| 31-2 | 31 | Excellent | 120 | 125 | 96.0 | 95% YS |

As is apparent from Table 6, the steels Nos. 29 to 31, having chemical compositions regulated in the present invention, have excellent hardenability, high yield ratio, and excellent sulfide stress cracking resistance. In particular, the marks 29-2, 30-2, 31-1 and 31-2, whose tensile strengths are not more than 130 ksi (897 MPa), have better sulfide stress cracking resistance.

Although only some exemplary embodiments of the present invention have been described in detail above, those skilled in the art will readily appreciated that many modifications are possible in the exemplary embodiments without materially departing from the novel teachings and advantages of the present invention. Accordingly, all such modifications are intended to be included within the scope of the present invention.

INDUSTRIAL APPLICABILITY

The seamless steel pipe for oil wells of the present invention is highly strong and excellent in sulfide stress cracking resistance because it has a high yield ratio even with a quenched and tempered microstructure, namely a tempered martensitic microstructure, in which the prior-austenite grains are relatively coarse gains of No. 7 or less by the grain size number regulated in JIS G 0551 (1998).

The seamless steel pipe for oil wells of the present invention can be produced at a low cost by adapting an in-line tube making and heat treatment process having a high production efficiency since a reheating treatment for refinement of grains is not required.

What is claimed is:

1. A method for producing a seamless steel pipe for oil wells, which comprises the steps of making a pipe by hot-piercing a steel billet having a chemical composition consisting of, on the percent by mass basis, C: 0.1 to 0.20%, Si: 0.05 to 1.0%, Mn: 0.05 to 1.0%, Cr: 0.05 to 1.5%, Mo: 0.05 to 1.0%, Al: 0.10% or less, Ti: 0.002 to 0.05% and B: 0.0003 to 0.005%, with the balance being Fe and impurities, and in the impurities P: 0.025% or less, S: 0.010% or less and N: 0.007% or less, with a value of A determined by the following equation (1) of 0.43 or more followed by elongating and rolling, and then finally rolling at a final rolling temperature adjusted to the $Ar_3$ transformation point to 1100 degrees centigrade, then following the final rolling step, the finally rolled steel pipe is assistantly heated in a temperature range from the $Ar_3$ transformation point to 1000 degrees centigrade in-line before the surface temperature becomes lower than the $Ar_3$ transformation point, and then the assistantly heated pipe is quenched from a temperature of the $Ar_3$ transformation point or higher and then tempered at a temperature lower than the $Ac_1$ transformation point, while keeping the pipe at a temperature of the $Ar_3$ transformation point or higher from tube-making to quenching:

$$A=C+(Mn/6)+(Cr/5)+(Mo/3) \quad (1),$$

wherein, in the equation (1), C, Mn, Cr and Mo each represent % by mass of the respective elements.

2. The method for producing a seamless steel pipe for oil wells according to claim 1, wherein the temperature of assistant heating in-line is the $Ac_3$ transformation point to 1000 degrees centigrade.

3. The method for producing a seamless steel pipe for oil wells according to claim 1, wherein the tensile strength is not more than 931 MPa.

4. A method for producing a seamless steel pipe for oil wells, which comprises the steps of making a pipe by hot-piercing a steel billet having a chemical composition consisting of, on the percent by mass basis, C: 0.1 to 0.20%, Si: 0.05 to 1.0%, Mn: 0.05 to 1.0%, Cr: 0.05 to 1.5%, Mo: 0.05 to 1.0%, Al: 0.10% or less, Ti: 0.002 to 0.05%, B: 0.0003 to 0.005%, and V: 0.03 to 0.2%, with the balance being Fe and impurities, and in the impurities P: 0.025% or less, S: 0.010% or less and N: 0.007% or less, with a value of A determined by the following equation (1) of 0.43 or more followed by elongating and rolling, and then finally rolling at a final rolling temperature adjusted to the $Ar_3$ transformation point to 1100 degrees centigrade, then following the final rolling step, the finally rolled steel pipe is assistantly heated in a temperature range from the $Ar_3$ transformation point to 1000 degrees centigrade in-line before the surface temperature becomes lower than the $Ar_3$ transformation point, and then the assistantly heated pipe is quenched from a temperature of the $Ar_3$ transformation point or higher and then tempered at a temperature lower than the $Ac_1$ transformation point, while keeping the pipe at a temperature of the $Ar_3$ transformation point or higher from tube-making to quenching:

$$A=C+(Mn/6)+(Cr/5)+(Mo/3) \quad (1),$$

wherein, in the equation (1), C, Mn, Cr and Mo each represent % by mass of the respective elements.

5. The method for producing a seamless steel pipe for oil wells according to claim 4, wherein the tensile strength is not more than 931 MPa.

6. The method for producing a seamless steel pipe for oil wells according to claim 4, wherein the temperature of assistant heating in-line is the $Ac_3$ transformation point to 1000 degrees centigrade.

7. A method for producing a seamless steel pipe for oil wells, which comprises the steps of making a pipe by hot-piercing a steel billet having a chemical composition consisting of, on the percent by mass basis, C: 0.1 to 0.20%, Si: 0.05 to 1.0%, Mn: 0.05 to 1.0%, Cr: 0.05 to 1.5%, Mo: 0.05 to 1.0%, Al: 0.10% or less, Ti: 0.002 to 0.05%, B: 0.0003 to 0.005%, and one or more element(s) selected from a group of Ca of 0.0003 to 0.005%, Mg of 0.0003 to 0.005% and REM of 0.0003 to 0.005%, with the balance being Fe and impurities, and in the impurities P: 0.025% or less, S: 0.010% or less and N: 0.007% or less, with a value of A determined by the following equation (1) of 0.43 or more followed by elongating and rolling, and then finally rolling at a final rolling temperature adjusted to the $Ar_3$ transformation point to 1100 degrees centigrade, then following the final rolling step, the finally rolled steel pipe is assistantly heated in a temperature range from the $Ar_3$ transformation point to 1000 degrees centigrade in-line before the surface temperature becomes lower than the $Ar_3$ transformation point, and then the assistantly heated pipe is quenched from a temperature of the $Ar_3$ transformation point or higher and then tempered at a temperature lower than the $Ac_1$ transformation point, while keeping the pipe at a temperature of the $Ar_3$ transformation point or higher from tube-making to quenching:

$$A=C+(Mn/6)+(Cr/5)+(Mo/3) \quad (1),$$

wherein, in the equation (1), C, Mn, Cr and Mo each represent % by mass of the respective elements.

8. The method for producing a seamless steel pipe for oil wells according to claim 7, wherein the tensile strength is not more than 931 MPa.

9. The method for producing a seamless steel pipe for oil wells according to claim 7, wherein the temperature of assistant heating in-line is the $Ac_3$ transformation point to 1000 degrees centigrade.

10. A method for producing a seamless steel pipe for oil wells, which comprises the steps of making a pipe by hot-piercing a steel billet having a chemical composition consisting of, on the percent by mass basis, C: 0.1 to 0.20%, Si: 0.05 to 1.0%, Mn: 0.05 to 1.0%, Cr: 0.05 to 1.5%, Mo: 0.05 to 1.0%, Al: 0.10% or less, Ti: 0.002 to 0.05%, B: 0.0003 to 0.005%, V: 0.03 to 0.2%, and one or more element(s) selected from a group of Ca of 0.0003 to 0.005%, Mg of 0.0003 to 0.005% and REM of 0.0003 to 0.005%, with the balance being Fe and impurities, and in the impurities P: 0.025% or less, S: 0.010% or less and N: 0.007% or less, with a value of A determined by the following equation (1) of 0.43 or more followed by elongating and rolling, and then finally rolling at a final rolling temperature adjusted to the $Ar_3$ transformation point to 1100 degrees centigrade, then following the final rolling step, the finally rolled steel pipe is assistantly heated in a temperature range from the $Ar_3$ transformation point to 1000 degrees centigrade in-line before the surface temperature becomes lower than the $Ar_3$ transformation point, and then the assistantly heated pipe is quenched from a temperature of the $Ar_3$ transformation point or higher and then tempered at a temperature lower than the $Ac_1$ transformation point, while keeping the pipe at a temperature of the $Ar_3$ transformation point or higher from tube-making to quenching:

$$A=C+(Mn/6)+(Cr/5)+(Mo/3) \quad (1),$$

wherein, in the equation (1), C, Mn, Cr and Mo each represent % by mass of the respective elements.

11. The method for producing a seamless steel pipe for oil wells according to claim 10, wherein the tensile strength is not more than 931 MPa.

12. The method for producing a seamless steel pipe for oil wells according to claim 10, wherein the temperature of assistant heating in-line is the $Ac_3$ transformation point to 1000 degrees centigrade.

* * * * *